US005812069A

United States Patent [19]

Albrecht et al.

[11] Patent Number: 5,812,069

[45] Date of Patent: Sep. 22, 1998

[54] METHOD AND SYSTEM FOR FORECASTING TRAFFIC FLOWS

[75] Inventors: Uwe Albrecht, München; Josef Heimann, Düsseldorf; Werner Schulz, Meerbusch, all of Germany

[73] Assignee: Mannesmann Aktiengesellschaft, Düsseldorf, Germany

[21] Appl. No.: 677,615

[22] Filed: Jul. 8, 1996

[30] Foreign Application Priority Data

Jul. 7, 1995 [DE] Germany ..... 195 26 148.8

[51] Int. Cl.[6] ..... G08G 1/09

[52] U.S. Cl. ..... 340/905; 340/988; 701/117

[58] Field of Search ..... 340/905, 928, 340/934, 988; 364/436, 437; 701/117, 118; 345/935

[56] References Cited

U.S. PATENT DOCUMENTS

| | | | |
|---|---|---|---|
| 5,132,684 | 7/1992 | Pecker et al. | 340/990 |
| 5,317,311 | 5/1994 | Martell et al. | 340/901 |
| 5,402,117 | 3/1995 | Zijderhand | 340/905 |
| 5,465,289 | 11/1995 | Kennedy, Jr. | 340/910 |
| 5,513,110 | 4/1996 | Fujita et al. | 340/990 |
| 5,610,821 | 3/1997 | Gazis et al. | 340/990 |

*Primary Examiner*—Edward Lefkowitz
*Attorney, Agent, or Firm*—Cohen, Pontani, Lieberman, Pavane

[57] ABSTRACT

A method and system for forecasting traffic flows at selected locations or in selected sections of road network, which method includes continually determining actual location positions of a plurality of vehicles of a spot check vehicle fleet, storing on the vehicles the determined actual positions as route data of a route traveled by the vehicles, transmitting the route data at intervals from more than one vehicle to a traffic computer containing a digital road map, and determining traffic flow data from the route data using the traffic computer. The traffic flow data includes information concerning traffic density. The inventive method then continues with assigning the traffic flow data to the selected locations and/or sections using the traffic computer, determining and/or updating statistical traffic flow data as time-dependent empirical values from the traffic flow data using the computer, registering actual driving activity data with driving activity sensors over a predefined physical area surrounding the selected locations and sections, transmitting the actual driving activity data to the traffic computer, and forecasting the traffic flows, using the computer, by starting from the actual driving activity data and extrapolating associated traffic flow data and factoring in the time-dependent empirical values.

15 Claims, 1 Drawing Sheet

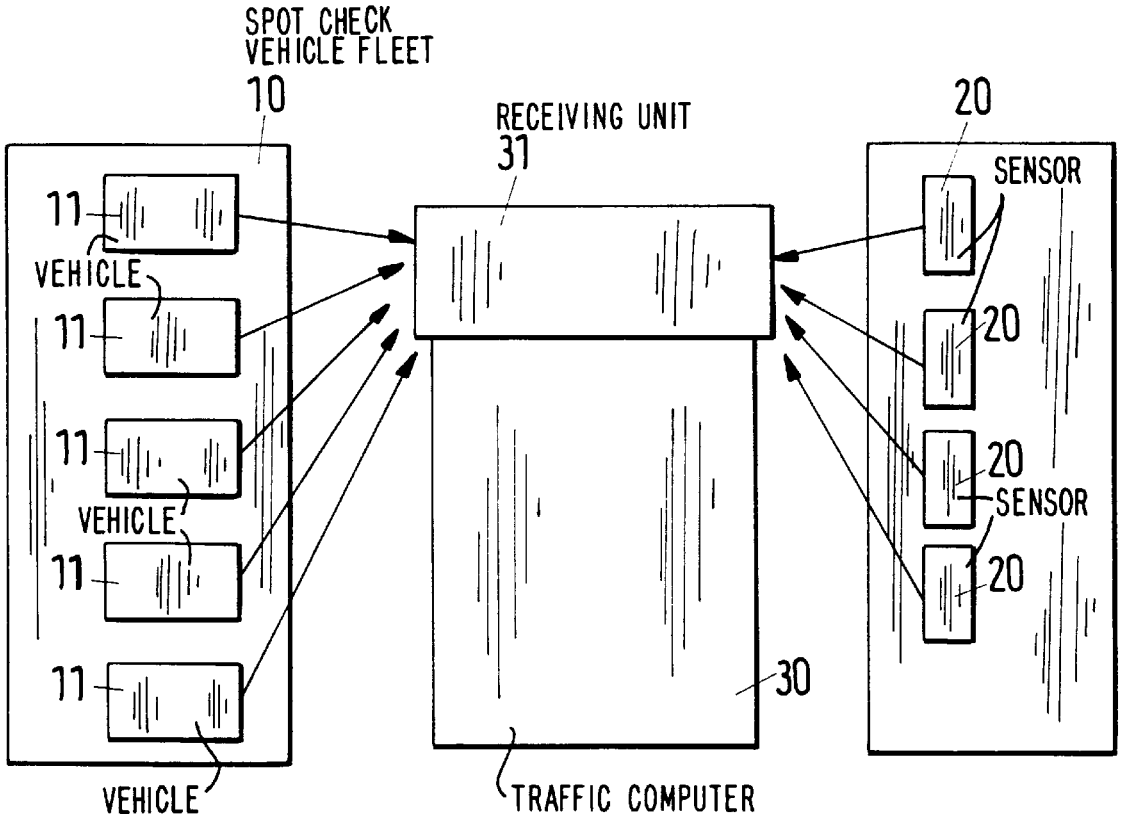
SPOT CHECK
VEHICLE FLEET
10
RECEIVING UNIT
31
20
SENSOR
11
VEHICLE
11
11
VEHICLE
11
11
VEHICLE
20
20
SENSOR
20
30
TRAFFIC COMPUTER

METHOD AND SYSTEM FOR FORECASTING TRAFFIC FLOWS

BACKGROUND OF THE INVENTION

1. Field of the Invention

The invention relates to a method and system for forecasting traffic flows at selected locations or in selected sections of a road network. More particularly, the invention relates to a method for directing traffic and guiding vehicles to their destinations, in which method determined traffic flow data which contains information at least about traffic density is used by a traffic computer, which has a digital road map, to forecast the traffic flows to be expected.

2. Description of the Prior Art

WO 89/02142 discloses a system for the optimum utilization of a road network, which, at selected locations or in selected sections, has at least one recording sensor which registers the status of the traffic, in particular the traffic density. The traffic status data is subsequently transmitted to a control station, which may be a traffic computer. In the control station, the processing and conditioning of the traffic status data are carried out, and the data is subsequently used for direct traffic control, for example by means of directly informing the vehicle driver. Directing of the traffic is carried out on the basis of a comparison between the desired and actual traffic status data from selected locations or selected sections of the road network. The desired values in this case correspond, for example, to the optimum condition of the traffic on the corresponding section of the road network. For improved registration of the traffic flows, the traffic status data from two measurement points which is determined at different locations is subjected, for example, to a correlation analysis in order to obtain information therefrom inter alia about the traffic flows.

This known system for the improved utilization of an existing road network, is disadvantageous in that the traffic flows can be forecast only to an insufficient extent since, in particular, it is only possible to determine to a limited extent from which partial flows the determined traffic flows are composed. Forecasting the traffic flows at selected locations or in selected sections is thus subject to considerable uncertainty in the case of this system.

SUMMARY OF THE INVENTION

Accordingly, it is an object of the present invention to provide a method and a system which make reliable forecasting of the traffic flows at selected locations or in selected sections of a road network possible and thereby permit, in particular, effective traffic direction and guiding of vehicles to their destinations.

Pursuant to this object, and others which will become apparent hereafter, one aspect of the present invention resides in a method for forecasting traffic flows at selected locations or in selected sections of road network, which method includes continually determining actual location positions of a plurality of vehicles of a spot check vehicle fleet, storing on the vehicles the determined actual positions as route data of a route traveled by the vehicles, transmitting the route data at intervals from more than one vehicle to a traffic computer containing a digital road map, and determining traffic flow data from the route data using the traffic computer. The traffic flow data includes information concerning traffic density. The inventive method then continues with assigning the traffic flow data to the selected locations and/or sections using the traffic computer, determining and/or updating statistical traffic flow data as time-dependent empirical values from the traffic flow data using the computer, registering actual driving activity data with driving activity sensors over a predefined physical area surrounding the selected locations and sections, transmitting the actual driving activity data to the traffic computer, and forecasting the traffic flows, using the computer, by starting from the actual driving activity data and extrapolating associated traffic flow data and factoring in the time-dependent empirical values.

The invention provides for vehicles of a spot check vehicle fleet in each case to determine and store their actual location position as a function of time and/or distance. This results in the determined location positions being available for evaluation as route data of the route traveled. For this purpose, at least some of the vehicles of the spot check vehicle fleet transmit the route data to a traffic computer at intervals. The traffic computer determines from the actually registered route data the traffic flows and their composition, that is to say the partial flows from which the traffic flows are essentially composed, and assigns these to the selected locations or sections. At the same time, the determined traffic flows and their composition serve for determining and/or updating statistical traffic flow data, which is used by the traffic computer as time-dependent empirical values for forecasting the traffic flows. In addition, for forecasting the traffic flows, actual driving activity data is registered over a predefined, relatively large physical area around the selected locations or sections of the road network and is transmitted to the traffic computer. Thus, the traffic computer, starting from the driving activity data, can determine the forecast of the traffic flows at the selected locations or in the selected sections by extrapolating the associated traffic flow data, taking into account the time-dependent empirical values. It is also possible to use, as actual driving activity data, data which does not in every case already represent a factual driving activity but only points to a directly imminent driving activity (e.g. the readiness indication of a mobile radio telephone in a vehicle which has only just been started).

In this method for forecasting the traffic flows using route data from a plurality of vehicles, the traffic computer makes use not only of traffic flow data at specific times, but also of information regarding the traffic flows from which this traffic flow data is composed. The route data transmitted by the vehicles of the spot check vehicle fleet contains, on the one hand, information, for example, about the relative traffic density at individual locations or in individual sections and, on the other hand, also contains information about which traffic flows contribute to bringing about this traffic density. It is thus possible, for example from the number of active motor vehicles in a predefined, relatively large physical area around the selected locations or sections, to predict reliably the short-term or long-term expected traffic flows at the selected locations or in the selected sections.

In order not to overload the transmission channels for the transmission of the route data, the route data is transmitted in reduced form by removing redundant data which, for example, is contained in the route data while traveling along a straight road or freeway. The transmission is expediently carried out via a radio telephone.

The determining and/or updating of statistical traffic flow data is carried out as a function of parameters if the traffic flows have to be forecast with relatively high certainty. Thus, the traffic flow data is determined and/or updated, for example, as a function of the day of the week and the time of day.

It is expedient to transmit the route data of the route traveled and the driving activity data to the traffic computer under specific conditions only following a request by the computer.

The actual driving activity data expediently comprises the operational state of the vehicles, which are equipped with a driving activity sensor.

As a result of the invention, it is advantageously proposed to register the driving activity data by interrogating and evaluating the activity of mobile radio telephone networks. For this purpose, it is possible in particular to utilize the readiness indication when starting the vehicle. In this case, the installation of special vehicle activity sensors is rendered superfluous.

The magnitude of the physical area in which the directly imminent or already running driving activities are registered is expediently predefined as a function of population density.

A system for implementing the method has vehicles of a spot check vehicle fleet, which in each case have means for determining their actual location position. Each of the vehicles further has means for storing at least the route data and means for transmitting the data to a receiving unit arranged in a fixed position outside the vehicles. The driving activities are registered by driving activity sensors which are arranged in a physically distributed manner along the road network and, in turn, have means for transmitting the registered driving activity data to the fixedly arranged receiving unit. Furthermore, the system comprises a traffic computer which has a digital road map, an electronic memory for storing empirical values and is connected to the receiving unit for receiving the data transmitted by the vehicles of the spot check vehicle fleet and by the driving activity sensors.

The determination of the actual location position is expediently carried out by means of a receiver for signals from navigational satellite systems (e.g. GPS), since this receiver is of small construction and the location position can be technically relatively simply determined with sufficient accuracy.

In another embodiment of the invention, the traffic computer has a transmitting unit for transmitting requests to the driving activity sensors. Thus, the driving activity sensors can be controlled from the traffic computer via a receiving unit which is likewise provided. In this way, it is possible for the traffic computer to retrieve the driving activity data as required.

Furthermore, it is advantageous if the vehicles of the spot check vehicle fleet likewise have a receiving unit for receiving requests from the traffic computer.

In order to ensure reliable forecasting of the traffic flows, provision is made for the driving activity sensors to be installed as far as possible in a plurality of vehicles and for the driving activity data to be transmitted to the traffic computer in a form which makes them anonymous, for example when starting the vehicle. The driving activity sensors are also, for example, installed in vehicles which do not belong to the spot check vehicle fleet. However, it is also conceivable for the driving activity sensors to be installed, for example, in a fixed manner in the roadway covering of side streets within a residential area, in order to register the number of active vehicles which, with a specific probability, offset in time, contribute to the corresponding traffic flows at the selected locations or in the selected sections of the road network.

The vehicles expediently also have a sensor for registering the instantaneous vehicle speed. The traffic flows can then be determined with more accuracy and can be linked directly to the traffic density.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The single FIGURE schematically shows the inventive system for forecasting the traffic flows at selected locations or in selected sections of a road network pursuant to the inventive method.

DETAILED DESCRIPTION OF THE PREFERRED EMBODIMENTS

The system for implementing the inventive method for forecasting the traffic flows essentially comprises three partial systems: a spot check vehicle fleet 10, driving activity sensors 20, which may be installed, in particular, in the vehicles 11 of the spot check vehicle fleet 10, and a traffic computer 30. The driving activity sensors 20, which are arranged in a physically distributed manner, may be mobile or else stationary driving activity sensors 20 arranged along the road network. The essential factor is that driving activity sensors 20 are arranged such that they are distributed physically over a specific geographical area, in order to register the driving activities with as large an "area coverage" as possible. The partial systems can be connected to one another in terms of data.

To produce the data connection to the traffic computer 30, the vehicles 11 of the spot check vehicle fleet 10 are each equipped with a transmitter. The driving activity sensors 20 also form, together with a transmitter, a unitary device which is capable of automatically transmitting driving activity data to the traffic computer 30. To receive the route data from the vehicles 11 of the spot check vehicle fleet 10, and the driving activity data registered by the driving activity sensors 20, the traffic computer 30 is provided with an appropriate receiving unit 31. In addition, the transmitting units of the vehicles 11 of the spot check vehicle fleet 10 and/or the driving activity sensors 20 may be equipped with a receiving device. These receiving devices can make possible the reception of requests from the traffic computer, which can call up the appropriate route and driving activity data when there is a corresponding requirement for information, for example in the case of difficult traffic situations on corresponding sections of the road network.

The computational means installed in the vehicles of the spot check vehicle fleet 10 comprise a device for determining the actual location position and expediently also the instantaneous vehicle speed, a memory for storing at least the route data and the already mentioned transmitting device for transmitting data to the traffic computer 30, which is arranged in a fixed position outside the vehicles 11. To determine the actual location position and the instantaneous vehicle speed, in another embodiment of the invention, a receiver for signals from navigational satellite systems is provided in the vehicles of the spot check vehicle fleet 10. The registration of the instantaneous vehicle speed can, of course, also be carried out by means of separate sensors (e.g. tachometers). The traffic flows at selected locations or in selected sections of the road network can then be determined more precisely and linked directly to the vehicle density (number of vehicles=average speed divided by vehicle density).

To store the route data of the distance traveled by a vehicle 11, a storage unit is provided in each of the vehicles 11 of the spot check vehicle fleet 10. The storage unit is expediently organized like a ring buffer system and only registers the information over a limited period. The storage of the location positions determined by the receiver for signals from navigational satellite systems and the data transmission to the traffic computer 30 are expediently controlled by a microprocessor integrated in the vehicle. The transmitting unit installed in the vehicles 11 makes possible the transmission of the route data to the traffic computer 30, the triggering of the data transmission being carried out by the microprocessor.

The traffic computer 30, which is arranged outside the vehicles 11 of the spot check vehicle fleet 10, is connected directly to one receiving unit 31. The routes of the vehicles 11 of the spot check vehicle fleet 10 are transmitted to the traffic computer 30 via this connection. In order to store the routes, the traffic computer 30 is equipped with appropriate memory means. A digital road map provided in the traffic computer 30 permits the assignment of the routes to the associated road sections. The empirical values derived from the routes in relation to the traffic flows and their composition at selected locations or in selected sections of the road network are stored in a specific memory unit in the traffic computer 30.

In order to be able to register driving activities in a predefined, relatively large area around a selected location or section, vehicle activity sensors 20 are arranged in a physically distributed manner in this area. The phrase "in a physically distributed manner" is not to be understood as only meaning statically, since the driving activity sensors 20 may, for example, be sensors which are installed in vehicles, register the operational state of the vehicle and, under specific predefined or predefinable conditions or immediately, can transmit it to the traffic computer 30. The driving activity sensors 20 may also be sensors which do not or not only register actual driving activities of a vehicle but register such events as are associated with imminent driving activities. The imminent driving activities may in this case be associated with the registered events with a specific statistical certainty. Therefore, the driving activity sensors 20 may be mobile radio telephones whose activity within a mobile radio telephone network is registered and evaluated in order to obtain information about imminent or actual driving activities. In this case, the "driving activity sensors" are not equipped with a special transmitting device for transmitting the registered activity data to the traffic computer 30, but rather the mobile radio telephone network undertakes the data transmission to the traffic computer 30, using its transmitting units.

The starting point of the method for forecasting the traffic flows at selected locations or in selected sections of a road network is constituted by the vehicles 11 of the spot check vehicle fleet 10 which automatically determine their route, while moving within a road network. The movement of these vehicles 11 within the road network takes place in this case, for example, randomly and without specific rules. By means of, for example, a receiver for signals from navigational satellite systems, the actual location position and the instantaneous vehicle speed are continually determined in the vehicle, and stored sequentially together in a memory unit. These stored location positions represent the most important part of the route data, to which in particular the time of the respective location position determination can also belong. However, it is also possible for the entire route and hence the route data in its entirety to be assigned only one time or one time span. An assignment of time to the route data is carried out if a time-dependent evaluation is envisaged. The route data is transmitted by means of the transmitting unit from the vehicles 11 of the spot check vehicle fleet 10 to the receiving unit 31, arranged in a fixed position, of the traffic computer 30. The transmission of the route data is carried out as a function of time and/or distance, and can be carried out regularly, irregularly or else on request. The receiving unit 31 forwards the route data to the traffic computer 30, which stores the latter initially in a memory or region of memory provided for this purpose.

For the purpose of evaluation by the traffic computer 30, the route data is in each case assigned to the individual sections of the road network on the digital road map. The traffic computer 30 then determines the significant partial flows (partial traffic flows) and the traffic densities effected thereby at least one selected location or in at least one selected section of the road network relative to one another, that is to say in each case the percentage proportion of a partial flow in relation to the total traffic flow at a selected location or in a selected section of a road network is determined. These traffic flow relationships determined in this way are compared with the empirical values present in the memory, that is to say with the empirical values at the same time of a corresponding day of the week, taking into account specific boundary conditions, and are modified. A specific boundary condition would be, for example, the beginning of school vacations on this day in a specific state, and the like. The modification can be carried out, for example, by performing special averaging in which the weighted average of the actual traffic flow relationships and the "empirical traffic flow relationships" at the selected location or in the selected section at such a time on a corresponding day of the week is formed while taking into account specific boundary conditions. An updating of the time-dependent "empirical traffic flow relationships" by the traffic computer 30 is then expediently carried out, for example likewise by means of weighted averaging.

In parallel with the registration, transmission and evaluation of the route data, the driving activity data, which is determined by the driving activity sensors 20 in a predefined, relatively large area around a selected location or section, is transmitted to the receiving unit 31, is forwarded by the receiving unit 31 to the traffic computer 30 and is stored by the traffic computer 30 in a memory or region of memory provided for this purpose and is evaluated at a suitable time. The evaluation is carried out in that, starting from the determined driving activity data, that is to say the driving activities, partial flows (partial traffic flows) which result therefrom with a specific statistical probability are derived. This may, once again, be carried out using empirical values stored in the memory.

The forecasting of the traffic flows at selected locations or in selected sections of a road network is then carried out with the aid of the partial flows partial traffic flows) derived from the vehicle activity data, using the determined traffic flow relationships, that is to say essentially by extrapolating the traffic flow data (traffic flow relationships) assigned to the locations or sections, taking into account empirical values which may, in particular, be time-dependent. Subsequently, suitable measures to influence traffic or to guide vehicles to their destinations can be carried out using the forecast traffic flows.

The method according to the invention mainly supplies the traffic flow relationships at selected locations or in selected sections of a road network. The determination of the absolute traffic densities, if these are needed, must as a rule be carried out by supplementary methods. This determination of the absolute traffic density may, however, be undertaken on the basis of empirical values. It is also possible to distribute a number of traffic density sensors in the road network and hence to calibrate the traffic flow relationships, that is to say to assign absolute traffic densities to selected locations or sections on the basis of the determined traffic flow relationships.

The invention is not limited by the embodiments described above which are presented as examples only but can be modified in various ways within the scope of protection defined by the appended patent claims.

We claim:

1. A method for forecasting traffic flows at selected locations and in selected sections of a road network, comprising the steps of:

a) continually determining actual location positions of a plurality of vehicles of a spot check vehicle fleet;

b) storing on the vehicles the determined actual positions as route data of a route traveled by the vehicles;

c) transmitting the route data at intervals from more than one vehicle to a traffic computer containing a digital road map;

d) determining traffic flow data from the route data using the traffic computer, the traffic flow data including information concerning traffic density;

e) assigning the traffic flow data to the selected locations and sections using the traffic computer;

f) at least one of determining and updating statistical traffic flow data as time-dependent empirical values from the traffic flow data using the traffic computer;

g) registering actual driving activity data, with driving activity sensors, over a predefined physical area surrounding the selected locations and sections;

h) transmitting the actual driving activity data to the traffic computer; and i) forecasting the traffic flows, using the traffic computer, by starting from the actual driving activity data and extrapolating associated traffic flow data and factoring in the time-dependent empirical values.

2. A method as defined in claim 1, and further comprising the step of reducing the route data of the route traveled before the transmission to the traffic computer in the transmission step.

3. A method as defined in claim 1, wherein the step of at least one of determining and updating statistical traffic flow data includes at least one of determining and updating statistical traffic flow data as a function of predefined parameters.

4. A method as defined in claim 1, including transmitting the route data of the route traveled and the driving activity data to the traffic computer in response to a request by the traffic computer.

5. A method as defined in claim 1, wherein the step of registering actual driving activity data includes registering actual driving activity data indicating an operational state of a vehicle.

6. A method as defined in claim 1, wherein the registering step includes registering the driving activity data by interrogating and evaluating activity of mobile radio telephone networks.

7. A method as defined in claim 1, including predefining a physical area in which driving activity data is registered as a function of population density.

8. A method as defined in claim 1, wherein the registering step includes registering the driving activity data with at least one of mobile and stationary driving activity sensors.

9. A system for forecasting traffic flows in a road network, comprising:

a receiving unit;

a spot check vehicle fleet including a plurality of vehicles, each of the vehicles having means for determining actual location position of the vehicle in the road network, means for storing the location position as route data, and means for transmitting the route data to the receiving unit;

driving activity sensors arranged in a physically distributed manner in the road network and including means for transmitting driving activity data registered by the sensors to the receiving unit; and traffic computer means including a digital road map and an electronic memory, the traffic computer means being connected to the receiving unit so as to receive data transmitted from the vehicles and the driving activity sensors, the traffic computer means being operative to determine traffic flow data from the route data, and to extrapolate the traffic flow data starting from the driving activity data and the factoring in time-dependent empirical values to forecast traffic flows.

10. A system as defined in claim 9, wherein each of the vehicles further includes receiver means for receiving signals from navigational satellite systems for determining the actual location position.

11. A system as defined in claim 9, wherein the traffic computer means includes a transmitting unit for transmitting requests for data transmission, the driving activity sensors including a receiving device for receiving the requests for data transmission from the traffic computer means.

12. A system as defined in claim 11, wherein each of the vehicles of the spot check vehicle fleet has a receiving device for receiving the requests for data transmission from the traffic computer means.

13. A system as defined in claim 9, wherein the driving activity sensors include means for detecting an operational readiness indication of mobile radio telephones in a plurality of the vehicles.

14. A system as defined in claim 9, wherein the vehicles include a sensor for registering instantaneous vehicle speed.

15. A system for forecasting traffic flows in a road network, comprising:

receiving means for receiving at least one of route information and driving activity data;

at least one of a spot check vehicle fleet and driving activity sensors, the spot check vehicle fleet including a plurality of vehicles, each of the vehicles having means for determining actual location position of the vehicle in the road network, means for storing the location position as route data, and means for transmitting the route data to the receiving means, the driving activity sensors being arranged in a physically distributed manner in the road network and including means for transmitting driving activity data registered by the sensors to the receiving means; and traffic computer means including a digital road map and an electronic memory, the traffic computer means being connected to the receiving means so as to receive data transmitted from the at least one of the vehicles and the driving activity sensors, the traffic computer means being operative to determine traffic flow data from the route data, and to extract the traffic flow data starting from the driving activity data and then factoring in time-dependent empirical values to forecast traffic flows.

* * * * *